US010254667B2

(12) United States Patent
Tanaka et al.

(10) Patent No.: US 10,254,667 B2
(45) Date of Patent: Apr. 9, 2019

(54) ELECTROSTATIC CHARGE IMAGE DEVELOPING TONER SET, ELECTROSTATIC CHARGE IMAGE DEVELOPER SET, AND TONER CARTRIDGE SET

(71) Applicant: FUJI XEROX CO., LTD., Tokyo (JP)

(72) Inventors: Tomoaki Tanaka, Kanagawa (JP); Tetsuya Taguchi, Kanagawa (JP); Shinya Sakamoto, Kanagawa (JP); Ryutaro Kembo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/784,772

(22) Filed: Oct. 16, 2017

(65) Prior Publication Data

US 2018/0129145 A1 May 10, 2018

(30) Foreign Application Priority Data

Nov. 9, 2016 (JP) ..... 2016-219026

(51) Int. Cl.
*G03G 9/08* (2006.01)
*G03G 9/087* (2006.01)
(Continued)

(52) U.S. Cl.
CPC ..... *G03G 9/0819* (2013.01); *G03G 9/0806* (2013.01); *G03G 9/0821* (2013.01);
(Continued)

(58) Field of Classification Search
CPC ..... G03G 9/0819; G03G 9/0821; G03G 9/09; G03G 9/08797; G03G 9/0806
See application file for complete search history.

(56) References Cited

U.S. PATENT DOCUMENTS

2011/0097659 A1* 4/2011 Sugiura ..... G03G 9/0819 430/108.2
2011/0159422 A1 6/2011 Nakamura et al.
(Continued)

FOREIGN PATENT DOCUMENTS

JP 2002-108021 A 4/2002
JP 2011-133804 A 7/2011
(Continued)

*Primary Examiner* — Thorl Chea
(74) *Attorney, Agent, or Firm* — Oliff PLC

(57) ABSTRACT

An electrostatic charge image developing toner set includes a white toner that includes white toner particles containing a core and a coating layer which does not contain a coloring agent and a colored toner that includes colored toner particles containing a core and a coating layer which does not contain a coloring agent, wherein with respect to a difference between an average equivalent circle diameter [Rw1] of the cores ($W_{in}$) in the white toner particles and an average equivalent circle diameter [Rw2] of the white toner particles [Rw2−Rw1], and a difference between the average equivalent circle diameter [Rc1] of the cores ($C_{in}$) in the colored toner particles and the average equivalent circle diameter [Rc2] of the colored toner particles [Rc2−Rc1], a relationship of the following Expression (1) is satisfied:

$$[Rw2-Rw1]<[Rc2-Rc1] \quad (1).$$

8 Claims, 2 Drawing Sheets

(51) Int. Cl.
*G03G 9/093* (2006.01)
*G03G 9/09* (2006.01)

(52) U.S. Cl.
CPC ..... *G03G 9/0827* (2013.01); *G03G 9/08797* (2013.01); *G03G 9/09* (2013.01); *G03G 9/09378* (2013.01); *G03G 9/09385* (2013.01); *G03G 9/09392* (2013.01)

(56) References Cited

U.S. PATENT DOCUMENTS

| | | | | |
|---|---|---|---|---|
| 2014/0045116 | A1* | 2/2014 | Agur ..... | G03G 9/0804<br>430/137.11 |
| 2014/0341615 | A1 | 11/2014 | Yamashita et al. | |
| 2014/0369723 | A1 | 12/2014 | Takahashi et al. | |
| 2015/0362872 | A1* | 12/2015 | Kawamura ..... | G03G 15/6585<br>430/105 |

FOREIGN PATENT DOCUMENTS

| | | | |
|---|---|---|---|
| JP | 2014-228554 | A | 12/2014 |
| JP | 2015-001628 | A | 1/2015 |

* cited by examiner

ELECTROSTATIC CHARGE IMAGE DEVELOPING TONER SET, ELECTROSTATIC CHARGE IMAGE DEVELOPER SET, AND TONER CARTRIDGE SET

CROSS-REFERENCE TO RELATED APPLICATIONS

This application is based on and claims priority under 35 USC 119 from Japanese Patent Application No. 2016-219026 filed Nov. 9, 2016.

BACKGROUND

1. Technical Field

The present invention relates to an electrostatic charge image developing toner set, an electrostatic charge image developer set, and a toner cartridge set.

2. Related Art

In electrophotographic image formation, a method of forming a white image on a recording medium as a base with a white toner and then forming a colored image on the base with a colored toner has been proposed.

In the related art, a method of forming a white image on various recording media such as plane paper and a film as a base with a white toner and forming a colored image on the base with a colored toner has been proposed. Note that, the white image formed as a based is required to have the properties of preventing the influence of coloration of the recording medium, that is, the high concealing properties; on the other hand, the colored image formed on the white image is required to have high color development to such an extent that the color toner enables color to be visually recognized.

SUMMARY

According to an aspect of the invention, there is provided electrostatic charge image developing toner set including:

a white toner that includes white toner particles containing a core ($W_{in}$) containing a binder resin and a white coloring agent, and a coating layer ($W_{out}$) which covers the core ($W_{in}$) and contains a binder resin without containing a coloring agent; and a colored toner that includes colored toner particles containing a core ($C_{in}$) containing a binder resin and a colored coloring agent, and a coating layer ($C_{out}$) which covers the core ($C_{in}$) and contains a binder resin without containing a coloring agent;

wherein with respect to a difference between an average equivalent circle diameter [Rw1] of the cores ($W_{in}$) in the white toner particles and an average equivalent circle diameter [Rw2] of the white toner particles [Rw2–Rw1], and a difference between the average equivalent circle diameter [Rc1] of the cores ($C_{in}$) in the colored toner particles and the average equivalent circle diameter [Rc2] of the colored toner particles [Rc2–Rc1], a relationship of the following Expression (1) is satisfied:

$$[Rw2-Rw1]<[Rc2-Rc1] \quad (1).$$

BRIEF DESCRIPTION OF THE DRAWINGS

Exemplary embodiments of the present invention will be described in detail based on the following figures, wherein.

DETAILED DESCRIPTION

Figure 1:
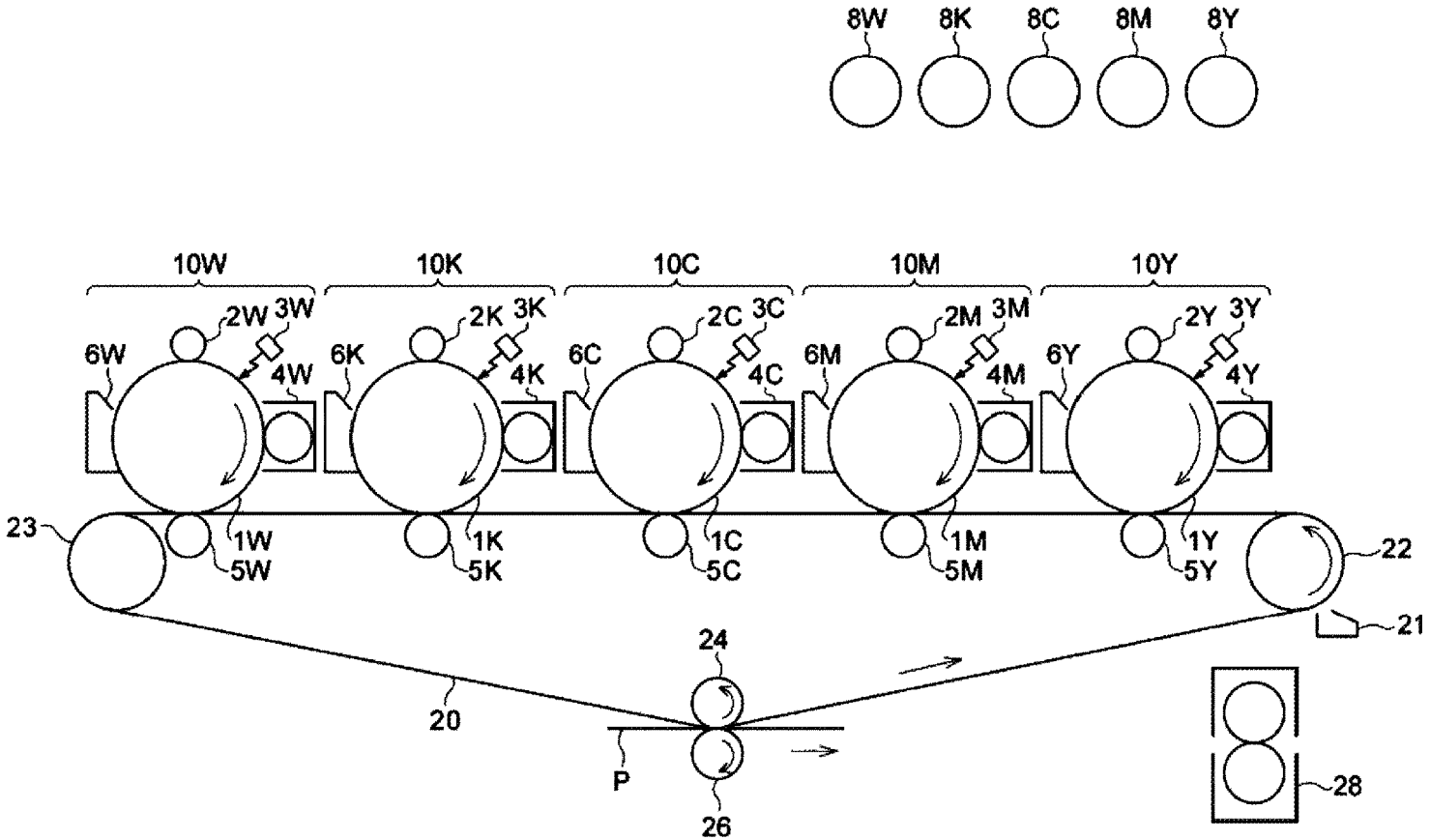
FIG. 1 is a configuration diagram illustrating an example of an image forming apparatus according to the exemplary embodiment.

Hereinafter, the exemplary embodiment which is an example of the invention will be described in detail.

Electrostatic Charge Image Developing Toner Set

An electrostatic charge image developing toner set (hereinafter, also simply referred to as a "toner set") according to the exemplary embodiment includes a white toner and a colored toner.

The white toner includes white toner particles containing a core ($W_{in}$) containing a binder resin and a white coloring agent, and a coating layer ($W_{out}$) which covers the core ($W_{in}$) and contains the binder resin without containing a coloring agent.

The colored toner includes colored toner particles containing a core ($C_{in}$) containing a binder resin and a colored coloring agent, and a coating layer ($C_{out}$) which covers the core ($C_{in}$) and contains the binder resin without containing a coloring agent.

In addition, when with respect to a difference between the average equivalent circle diameter [Rw1] particles of the cores ($W_{in}$) in the white toner and the average equivalent circle diameter [Rw2] of the white toner particles [Rw2–Rw1], and a difference between the average equivalent circle diameter [Rc1] of the cores ($C_{in}$) in the colored toner particles and the average equivalent circle diameter [Rc2] of the colored toner particles [Rc2–Rc1], a relationship of the following Expression (1) is satisfied.

$$[Rw2-Rw1]<[Rc2-Rc1] \quad \text{Expression (1):}$$

Here, the colored toner, the colored toner particles, the colored coloring agent, and the colored image mean toner, toner particles, a coloring agent, and an image, each having color other than white. For example, examples of the colored toner include a yellow (Y) toner, a magenta (M) toner, and a cyan (C) toner, and a black (K) toner.

In the exemplary embodiment, plural color toners may be used in combination as a colored toner, and for example, the combination of the four color toners of the yellow toner, the magenta toner, the cyan toner, and the black toner may be set as a toner set together with a white toner. In this case, at least one color toner of the colored toners may satisfy the above requirement. Here, all colored toners used in combination may satisfy the above requirements.

In the following description, in a case of indicating both of the white toner and the colored toner, it is simply referred to as toner. Further, in a case of indicating both of the white toner particles and the colored toner particles, it is simply referred to as toner particles, in a case of indicating both of the white coloring agent and the colored coloring agent, it is simply referred to as a coloring agent, and in a case of indicating both of the white image (a white toner image) and the colored image (a colored toner image), it is simply referred to as a toner image.

With such a configuration, the toner set according to the exemplary embodiment may realize both high concealing properties in the white toner image and high color development in the colored toner image.

The reason why this effect is exhibited is presumed as follows.

In the related art, various media such as plain paper and film have been used as a recording medium on which an image is formed, and presence or absence of surface roughness and degree of coloration are also different depending on the media. For this reason, at the time of forming a colored image, a difference in glossiness due to the surface roughness of the recording medium and coloration of the recording medium may cause image quality fluctuations such as color change in some cases. In this regard, in order to reduce influence of the surface roughness and degree of coloration of the recording medium, a method of forming a white image on the recording medium as a base with a white toner, and then forming a colored image on the white image with a colored toner has been proposed.

Note that, the white image formed as a based is required to have the properties of preventing the influence of coloration of the recording medium, that is, the high concealing properties; on the other hand, the colored image formed on the white image is required to have high color development so as to visually recognize the color by the color toner.

Here, in an image unit including the white image as a based and the colored image formed on the based, when light enters from the surface side of the colored image, the light behaves as follows, for example.

(1) Reflecting on the surface of the colored image, (2) when entering the colored image and hitting the colored coloring agent, a portion of the light component is absorbed and the remaining components are irregularly reflected, (3) passing through the colored image and reflects on the surface of the white image, (4) when entering the white image and hitting the white coloring agent, it is irregularly reflected, (5) passing through the colored image and the white image so as to reach the recording medium Further, in order to improve the concealing properties in the white image, it is required to decrease the amount of the light "(5) passing through the colored image and the white image so as to reach the recording medium"; on the other hand, in order to improve the color development in the colored image, it is required to increase the amount of not only the light in which "(2) when entering the colored image and hitting the colored coloring agent, a portion of the light component is absorbed and the remaining components are irregularly reflected" but also the light which is irregularly reflected when hitting the colored coloring agent.

In contrast, in the exemplary embodiment, both of the white toner particles and the colored toner particles include the coloring agent (the white coloring agent and the colored coloring agent) in the core ($W_{in}$ and $C_{in}$), but do not include the coloring agent in the coating layer ($W_{out}$ and $C_{out}$), that is the coating layer is transparent. Then, the relationship of the above Expression (1), In other words, the thickness of the coating layer of the white toner particles is smaller than that of the colored toner particles.

Here, from the viewpoint of obtaining high whiteness, a high content of the coloring agent (the white coloring agent) tends to be set in the white toner as compared with the colored toner, and particularly, the high content of the coloring agent is general in the white toner used as a base from the viewpoint of increasing the concealing rate. In addition, in the white toner particles, the core including a large amount of the coloring agent is hardly melted due to the effect of thixotropy by this coloring agent; on the other hand, the coating layer which does not include the coloring agent is melted easier than the core. In the exemplary embodiment, as described, in the white image which has thin coating layer of the white toner particles, and thus formed as a base, the shape of the core which is hardly melted remains even after the coating layer is melted at the time of fixing, and the shape of the core is reflected so that it becomes a white image having a surface shape with large roughness. Further, with the coating layer which is easily melted and thin, when the coating layer is melted the surface of the coating layer is roughened and thus smaller roughness is also formed. Accordingly, the surface of the white image has a complicated and rough shape with those large roughness and small roughness.

The surface of the white image has the complicated and rough shape is likely to allow the incident light to be irregularly reflected, and thus the light passing through the colored image and reaching the surface of the white image is likely to be irregularly reflected on this surface. Accordingly, the amount of the light "(4) which is irregularly reflected when entering the white image and hitting the white coloring agent" and the light "(5) passing through the colored image and the white image so as to reach the recording medium" is decreased, and thereby the concealing properties in the white image are improved.

Further, the white toner particles have a thin coating layer, which means that an area which does not include the coloring agent (the white coloring agent) is small. For this reason, an area in which the coloring agent is not present even becomes smaller in the white image, and thus the amount of the light "(4) which is irregularly reflected when entering the white image and hitting the white coloring agent is increased. As a result, the amount of the light "(5) passing through the colored image and the white image so as to reach the recording medium" is further decreased. With this, the concealing properties in the white image are improved.

In addition, regarding the light which is irregularly reflected on the surface of the white image, and the light hitting the white coloring agent in the white image so as to be irregularly reflected, when a portion thereof enters the colored image and hits the colored coloring agent, a portion of the light component is absorbed and the remaining components are irregularly reflected. With this, the amount of the light which is irregularly reflected is increased in the colored coloring agent, and thereby the color development in the colored image is improved.

As described above, in the toner set according to the exemplary embodiment, both of high concealing properties in the white toner image and high color development in the colored toner image are satisfied.

[Rw2−Rw1] and [Rc2−Rc1]

With respect to a difference between the average equivalent circle diameter [Rw1] of the cores ($W_{in}$) and the average equivalent circle diameter [Rw2] of the white toner particles in the white toner particles [Rw2−Rw1], and a difference between the average equivalent circle diameter [Rc1] of the cores ($C_{in}$) and the average equivalent circle diameter [Rc2] of the colored toner particles in the colored toner particles [Rc2−Rc1], in the exemplary embodiment, the relationship of the above Expression (1) ([Rw2−Rw1]<[Rc2−Rc1]) is satisfied.

When satisfying Expression (1), both of the high concealing properties in the white toner image and the high color development in the colored toner image are satisfied.

Note that, a difference between [Rw2−Rw1] in the white toner particles and [Rc2−Rc1] in the colored toner particles is preferably equal to or greater than 0.3 μm, and is further preferably equal to or greater than 0.7 μm.

Further, a value of [Rw2−Rw1] in the white toner particles preferably satisfies a relationship expressed by 0.1 μm≤Rw2−Rw1≤0.5 μm, further preferably satisfies a relationship expressed by 0.1 μm≤Rw2−Rw1≤0.3 μm, and still further preferably satisfies a relationship expressed by 0.1 μm≤Rw2−Rw1≤0.2 μm.

On the other hand, a value of [Rc2−Rc1] in the colored toner particles preferably satisfies a relationship expressed by 0.5 μm≤Rc2−Rc1≤1.5 μm, further preferably satisfies a relationship expressed by 0.8 μm≤Rc2−Rc1≤1.2 μm, and still further preferably satisfies a relationship expressed by 0.8 μm≤Rc2−Rc1≤1.0 μm.

[Rw1/Rw2] and [Rc1/Rc2]

With respect to the ratio of the average equivalent circle diameter [Rw1] of the cores ($W_{in}$) to the average equivalent circle diameter [Rw2] of the white toner particles in the white toner particles [Rw1/Rw2], and the ratio of the average equivalent circle diameter [Rc1] of the cores ($C_{in}$) to the average equivalent circle diameter [Rc2] of the colored toner particles in the colored toner particles [Rc1/Rc2], the relationship of the following Expression (2) is preferably satisfied.

$$[Rw1/Rw2]>[Rc1/Rc2] \quad \text{Expression (2):}$$

Note that, the value of [Rw1/Rw2] is an indicator representing the ratio of the thickness of the coating layer ($W_{out}$) to the size of the core ($W_{in}$) of the white toner particles; on the other hand, the value of [Rc1/Rc2] is an indicator representing the ratio of the thickness of the coating layer ($C_{out}$) to the size of the core ($C_{in}$) of the colored toner particles. That is, the fact that the value of [Rw1/Rw2] is greater than the value of [Rc1/Rc2] means that the ratio of the thickness of the coating layer ($W_{out}$) of the white toner particles to the size of the core ($W_{in}$) is smaller than the ratio of the thickness of the coating layer ($C_{out}$) of the colored toner particles to the size of the core ($C_{in}$). With such a configuration, the forming of the large roughness on the surface of the white image by the influence of the core which is hardly melted and the forming of the small roughness by the influence of the coating layer which is easily melted and thin are prompted. Therefore, it is likely that the surface of the white image has a complicated and rough shape, and as a result, both of the high concealing properties in the white toner image and the high color development in the colored toner image are satisfied.

Note that, the ratio of [Rw1/Rw2] to [Rc1/Rc2] is preferably from 1:0.8 to 1:0.99, and is further preferably from 1:0.8 to 1:0.88.

In addition, the ratio [Rw1/Rw2] in the white toner particles preferably satisfies a relationship expressed by 0.95≤Rw1/Rw2<1.0, further preferably satisfies a relationship expressed by 0.96≤Rw1/Rw2≤0.99, and still further preferably satisfies a relationship expressed by 0.97≤Rw1/Rw2≤0.99.

On the other hand, the ratio [Rc1/Rc2] in the colored toner particles preferably satisfies a relationship expressed by 0.8≤Rc1/Rc2<0.95, further preferably satisfies a relationship expressed by 0.8≤Rc1/Rc2≤0.90, and still further preferably satisfies a relationship expressed by 0.8≤Rc1/Rc2≤0.85.

Average Thickness of Coating Layers of White Toner Particles and Colored Toner Particles The average thickness [Tw1] of the coating layers ($W_{out}$) of the white toner particles preferably satisfies a relationship expressed by 0.1 μm≤Tw1≤0.5 μm, further preferably satisfies a relationship expressed by 0.1≤Tw1≤0.3, and further preferably satisfies a relationship expressed by 0.1≤Tw1≤0.2.

When the average thickness [Tw1] of the coating layers of the white toner particles is preferably equal to or smaller than 0.5 μm, the forming of the large roughness on the surface of the white image by the influence of the core which is hardly melted and the forming of the small roughness by the influence of the coating layer which is easily melted and thin are prompted. Therefore, it is likely that the surface of the white image has a complicated and rough shape, and as a result, both of the high concealing properties in the white toner image and the high color development in the colored toner image are satisfied.

On the other hand, when the average thickness [Tw1] is equal to or greater than 0.1 μm, a good adhesion state of the external additive is maintained, excellent stirring safety and charging safety in the developing machine may be obtained.

The average thickness [Tc1] of the coating layers ($C_{out}$) of the colored toner particles preferably satisfies a relationship expressed by 0.5 μm≤Tc1≤1.5 μm, further preferably satisfies a relationship expressed by 0.8≤Tc1≤1.2, and still further preferably satisfies a relationship expressed by 0.8≤Tc1≤1.0.

When the average thickness [Tc1] of the coating layers of the colored toner particles is equal to or smaller than 1.5 μm, excellent color development and transparency may be satisfied even in a low layered state (a state where the thickness of the colored toner image is small).

On the other hand, when the average thickness [Tc1] is equal to or greater than 0.5 μm, a good adhesion state of the external additive is maintained, excellent stirring safety and wearing safety in the developing machine may be obtained.

Average Equivalent Circle Diameter of White Toner Particles and Colored Toner Particles The average equivalent circle diameter [Rw2] of the white toner particles and the average equivalent circle diameter [Rc2] of the colored toner particles preferably satisfy a relationship of the following Expression (3).

$$[Rw2]>[Rc2] \quad \text{Expression (3):}$$

When the average diameter of the white toner particles used as a base is larger than the average diameter of the colored toner particles which are formed on the base, on an interface between the white toner layer (a white layer before fixing) and the colored toner layer (a colored layer before fixing), the white toner particles and the colored toner particles do not fit together and a gap is formed, and thus it is likely that roughness caused by the gap is formed on an interface between the white image and the colored image after fixing, and thereby the interface has a complicated and rough shape. As a result, both of the high concealing properties in the white toner image and the high color development in the colored toner image are satisfied.

Note that, the ratio of [Rw2] to [Rc2] is preferably from 1:0.5 to 1:0.95, and is further preferably from 1:0.6 to 1:0.8.

In addition, the average equivalent circle diameter [Rw2] of the white toner particles preferably satisfies a relationship expressed by 5.0 μm≤Rw2≤10.0 μm, further preferably satisfies a relationship expressed by 6.5 μm≤Rw2≤10.0 μm, and still further preferably satisfies a relationship expressed by 7.5 μm≤Rw2≤10.0 μm.

On the other hand, the average equivalent circle diameter [Rc2] of the colored toner particles preferably satisfies a relationship expressed by 3.0 μm≤Rc2≤7.0 μm, further preferably satisfies a relationship expressed by 3.0 μm≤Rc2≤6.0 μm, and still further preferably satisfies a relationship expressed by 3.0 μm≤Rc2≤5.0 μm.

Method of Measuring Average Equivalent Circle Diameter and Average Thickness

After embedding the toner particles with a bisphenol A type liquid epoxy resin and a curing agent, a cutting sample is prepared. Then, the sample is sliced at −100° C. by using a cutting machine of Ultracut UCT (manufactured by Leica) with a diamond knife, and thereby a sample for observation is prepared. The sample for observation is observed with a transmission electron microscope (S-4800, manufactured by Hitachi High-Technologies Corporation) at a magnification of 5000 times. Among cross sections of the toner particles (cross sections of the toner particles in the thickness direction), the surface of the toner particle and the surface of the core are determined from the interface in particles with different contrast, or the presence frequency of the coloring agent so as to calculate the equivalent circle diameter of the toner particles (primary particles), and the equivalent circle diameter of the core. Note that, the equivalent circle diameter here means a diameter of a circle with the same area as the projected area of observed toner particles and the core. The measurement of this equivalent circle diameter is performed for 50 particles, and the average value thereof is designated as an average equivalent circle diameter (μm).

In addition, regarding the measurement of the average thickness of the coating layers, the distance between the surface of the toner particle and the surface of the core in the observation of the above cross section is measured at 20 points in one toner particle, and this measurement is performed on 50 toner particles. The obtained average value is designated as an average thickness (μm).

Hereinafter, components of the toner (the white toner and the colored toner) included in the toner set according to the exemplary embodiment will be described.

The toner in the exemplary embodiment may include the toner particles, and further include external additives.

Toner Particles

The toner particle includes a core and a coating layer which covers the core. The core may include a binder resin and a coloring agent, and may further include a release agent and other additives. The coating layer includes the binder resin and does not include the coloring agent, and may also include the release agent and other additives.

Coloring Agent

White Coloring Agent in White Toner

In the white toner in the exemplary embodiment, a white coloring agent is included in the core of the toner particles. Examples of the white coloring agent include white pigments such as titanium oxide ($TiO_2$), zinc oxide (ZnO, zinc flower), calcium carbonate ($CaCO_3$), basic lead carbonate ($2PbCO_3Pb(OH)_2$, white lead), a mixture of zinc sulfide-barium sulfate (lithopone), zinc sulfide (ZnS), silicon dioxide ($SiO_2$, silica), and aluminum oxide ($Al_2O_3$, alumina). Among them, the titanium oxide ($TiO_2$) is preferably used. The white coloring agent may be used singly or in combination of two or more types thereof.

The white coloring agent may be subjected to a surface treatment, and may be used in combination with a dispersant. The average primary particle diameter of the white coloring agent is from 150 nm to 400 nm.

The content of the white coloring agent in the white toner particles is preferably from 15% by weight to 70% by weight, and is further preferably from 20% by weight to 60% by weight.

Examples of the colored coloring agent colored coloring agent in the colored toner include various pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite green oxalate, or various dies such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazole dye. The colored coloring agent may be used singly or in combination of two or more types thereof.

As the colored coloring agent, a coloring agent which is subjected to a surface treatment may be used if necessary, or a dispersant may be used in combination. In addition, plural kinds of colored coloring agents may be used in combination.

The content of the colored coloring agent in the colored toner particles is, for example, preferably from 1% by weight to 30% by weight, and is further preferably from 3% by weight to 15% by weight with respect to the entire toner particles.

Binder Resin

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and modified rosin, a mixture thereof with the above-described vinyl resins, or a graft polymer obtained by polymerizing a vinyl monomer with the coexistence of such non-vinyl resins.

These binder resins may be used singly or in combination of two or more types thereof.

As the binder resin, the polyester resin is preferably used.

Examples of the polyester resin include a well-known polyester resin.

Examples of the polyester resin condensation polymers of polyvalent carboxylic acids and polyol. A commercially available product or a synthesized product may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more types thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

The glass transition temperature (Tg) of the polyester resin is preferably from 50° C. to 80° C., and further preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the polyester resin is preferably from 5,000 to 1,000,000, and is further preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Regarding the content of the binder resin, for example, in the case of the colored toner, it is preferably from 40% by weight to 95% by weight, is further preferably from 50% by weight to 90% by weight, and is still further preferably from 60% by weight to 85% by weight with respect to the entire colored toner particles. On the other hand, in the case of the white toner, it is preferably from 20% by weight to 80% by weight, is further preferably from 30% by weight to 70% by weight, and is still further preferably from 40% by weight to 60% by weight with respect to the entire white toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is further preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

Regarding the content of the release agent, for example, in the case of the colored toner, it is preferably from 1% by weight to 20% by weight, and is further preferably from 5% by weight to 15% by weight with respect to the entire colored toner particles. On the other hand, in the case of the white toner, it is preferably from 1% by weight to 20% by weight, is further preferably from 3% by weight to 18% by weight, and is still further preferably from 5% by weight to 15% by weight with respect to the entire white toner particles.

Other Additives

Examples of other additives include well-known additives such as a magnetic material, a charge-controlling agent, and an inorganic powder. These additives are contained in the toner particle as internal additives.

Properties of Toner Particles

In the toner particles, both of the white toner particles and the colored toner particles may have a so-called core•shell structure composed of a core (core particle) and a coating layer (shell layer) coated on the core.

The average circularity of the toner particles is preferably from 0.94 or about 0.94 to 1.00 or about 1.00, and is further preferably from 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the value is measured according to the following method.

The average circularity of the toner particles is calculated by using a flow particle image analyzer (measured by FPIA-2100 manufactured by Sysmex Corporation) which first, suctions and collects the toner particles to be measured so as to form flat flow, then captures a particle image as a static image by instantaneously emitting strobe light, and then performs image analysis of the obtained particle image. 3,500 particles are sampled at the time of calculating the average circularity.

In a case where the toner contains an external additive, the toner (the developer) to be measured is dispersed in the water containing a surfactant, and then the water is subjected to an ultrasonic treatment so as to obtain the toner particles in which the external additive is removed.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobization treating agent is not particularly limited and examples thereof include a silane coupling agent, silicone oil, a titanate coupling agent, and an aluminum coupling agent. These may be used alone or in combination of two or more kinds thereof.

Generally, the amount of the hydrophobization treating agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably from 0.01% by weight to 5% by weight, and is further preferably from 0.01% by weight to 2.0% by weight with respect to the toner particles.

Preparing Method of Toner

Next, the method of preparing the toner will be described.

The toner of the exemplary embodiment is obtained by additionally adding the external additive to the toner particles after preparing the toner particles.

The toner particles may be prepared according to any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained according to the aggregation and coalescence method.

Specifically, for example, in a case where the toner particles are prepared according to the aggregation and coalescence method, the toner particles are prepared through the following steps.

The steps include a step (a resin particle dispersion preparing step) of preparing a resin particle dispersion in which resin particles constituting the binder resin are dispersed and a coloring agent particle dispersion in which particles of the coloring agent containing a white pigment (hereinafter, also referred to as "a coloring agent particle") are dispersed, a step (an aggregated particle forming step) of forming aggregated particles by aggregating the resin particles and coloring agent particles (other particles if necessary), in the dispersion in which the resin particle dispersion and the coloring agent particle dispersion are mixed with each other (in the dispersion in which other particle dispersions are mixed, if necessary); and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the coloring agent and the release agent will be described; however, the coloring agent and the release agent are used if necessary. Other additives other than the coloring agent and the release agent may also be used.

Resin Particle Dispersion Preparing Step

First, a resin particle dispersion in which the resin particles corresponds to the binder resins containing the crystalline polyester resin are dispersed, a coloring agent particle dispersion in which coloring agent particles are dispersed, and a release agent particle dispersion in which the release agent particles are dispersed are prepared, for example.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more types thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol. Among them, anionic surfactants and cationic surfactants are particularly preferable. Nonionic surfactants may be used in combination with anionic surfactants or cationic surfactants.

The surfactants may be used singly or in combination of two or more types thereof.

Regarding the resin particle dispersion, as a method of dispersing the resin particles in the dispersion medium, a common dispersing method using, for example, a rotary shearing-type homogenizer, or a ball mill, a sand mill, or a Dyno mill as media is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, further preferably from 0.08 μm to 0.8 μm, and still further preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and further preferably from 10% by weight to 40% by weight.

For example, the coloring agent particle dispersion and the release agent particle dispersion are also prepared in the same manner as in the case of the resin particle dispersion. That is, the resin particles in the resin particle dispersion are the same as the coloring agent particles dispersed in the coloring agent particle dispersion, and the release agent particles dispersed in the release agent particle dispersion, in terms of the volume average particle diameter, the dispersion medium, the dispersing method, and the content of the particles in the resin particle dispersion.

Aggregated Particle Forming Step

Next, the resin particle dispersion, the coloring agent dispersion, and the release agent particle dispersion are mixed with each other.

The resin particles, the coloring agent particles, and the release agent particle are heterogeneously aggregated in the mixed dispersion, thereby forming aggregated particles having a diameter near a target toner particle diameter and including the resin particles, the coloring agent particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, from glass transition temperature of −30° C. to glass transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersant to be added to the mixed dispersion, an inorganic metal salt, a divalent or more metal complex. Particularly, when a metal complex is used as the aggregating agent, the amount of the surfactant used is reduced and charging characteristics are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and is further preferably equal to or greater than 0.1 parts by weight and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the white toner particles and the colored toner particles are prepared through a step of forming second aggregated particles in such a manner that an aggregated particle dispersion in which the aggregated particles (the first aggregated particles) are dispersed are obtained, then the aggregated particle dispersion and a resin particle dispersion in which the resin particles are dispersed are mixed, and the mixtures are aggregated so as to be attached on the surface of the aggregated particle; and a step of forming the toner particles having a core/shell structure, in which a core and a coating layer which covers the core are provided, by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles. The mixing may be performed with, for example, a V-blender, a Henschel mixer, a Lodige mixer, or the like. Furthermore, if necessary, coarse particles of the toner may be removed by using a vibration sieving machine, a wind classifier, or the like.

Electrostatic Charge Image Developer Set

The electrostatic charge image developer set according to the exemplary embodiment includes at least the toner set according to the exemplary embodiment.

The electrostatic charge image developer set according to the exemplary embodiment may be a one-component developer which includes only the toner in the toner set according to the exemplary embodiment, or may be a two-component developer in which the toner and a carrier are mixed with each other.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluororesin, polyester, polycarbonate, a phenol resin, and an epoxy resin.

Note that, other additives such as the conductive particles may be contained in the coating resin and the matrix resin.

Examples of the conductive particle include metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably from toner: carrier=1:100 to 30:100, and is further preferably from 3:100 to 20:100.

Image Forming Apparatus and Image Forming Method

An image forming apparatus according to the exemplary embodiment and an image forming method will be described below. The image forming apparatus according to the exemplary embodiment is provided with a first image forming unit that forms a white image with the white toner in the electrostatic charge image developing toner set according to the exemplary embodiment, a second image forming unit that forms a colored image with the colored toner in the electrostatic charge image developing toner set according to the exemplary embodiment, a transfer unit that transfers the white image and the colored image onto the recording medium, and a fixing unit that fixes the white image and the colored image which are transferred onto the surface of the recording medium.

The image forming apparatus according to the exemplary embodiment may be provided with, as the first or second image forming unit, an image forming unit which is provided with an image holding member, a charging unit that charges the surface of the image holding member, an electrostatic charge image forming unit that forms an electrostatic charge image on the charged surface of the image holding member, and a developing unit that develops the electrostatic charge image formed on the surface of the image holding member as a toner image with the electrostatic charge image developer.

Alternatively, the image forming apparatus according to the exemplary embodiment may be provided with an image holding member, a charging unit that charges the surface of the image holding member, an electrostatic charge image forming unit that forms an electrostatic charge image on the charged surface of the image holding member, and a first and second developing units that develop the electrostatic charge image formed on the surface of the image holding member as a toner image by using the electrostatic charge image developer, as the first or second image forming unit.

In the image forming apparatus according to the exemplary embodiment, the image forming method (image forming method according to the exemplary embodiment) including a first image forming step of forming a white image with the white toner in the electrostatic charge image developing toner set according to the exemplary embodiment, a second image forming step of forming a colored image with the colored toner in the electrostatic charge image developing toner set according to the exemplary embodiment, a step of transferring the white image and the colored image onto a recording medium, and a step of fixing the white image and the colored image on the recording medium is performed.

As the image forming apparatus according to the exemplary embodiment, well-known image forming apparatuses such as an apparatus including a direct-transfer type apparatus that directly transfers the toner image (the white image and colored image in the exemplary embodiment) formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; an apparatus a cleaning unit that cleans the surface of the image holding member before being charged and after transferring the toner image; and an apparatus includes an erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer in the exemplary embodiment may be used.

The image forming apparatus according to the exemplary embodiment may be an image forming apparatus that accommodates the white toner included in the toner set according to the exemplary embodiment in the developing unit, and accommodates as a colored toner, at least one selected from yellow toner, magenta toner, cyan toner, and black toner in the developing unit.

Hereinafter, an example of the image forming apparatus of the exemplary embodiment will be described; however, the invention is not limited thereto. Note that, in the drawing, major portions will be described, and others will not be described.

FIG. 1 is a configuration diagram illustrating the image forming apparatus according to the exemplary embodiment, and is a diagram illustrating an image forming apparatus of a 5-tandem tandem type and an intermediate transfer type.

The image forming apparatus as illustrated in FIG. 1 is provided with electrophotographic type first to fifth image forming units 10Y, 10M, 10C, 10K, and 10W (image forming unit) that output an image for each color of yellow (Y), magenta (M), cyan (C), black (K), and white (W) based on color separated image data. These image forming units 10Y, 10M, 10C, 10K, and 10W (hereinafter, simply referred to as a "unit" in some cases) are arranged apart from each other by a predetermined distance in the horizontal direction. Note that, the units 10Y, 10M, 10C, 10K, and 10W may be the process cartridge which is detachable from the image forming apparatus.

An intermediate transfer belt (an example of the intermediate transfer) 20 passing through the respective units is extended downward the respective units 10Y, 10M, 10C, 10K, and 10W. The intermediate transfer belt 20 is provided to be wound by a driving roller 22, a supporting roller 23, and a facing roller 24 which contact the inner surface of an intermediate transfer belt 20, and travels to the direction from the first unit 10Y to the fifth unit 10W. An intermediate transfer member cleaning device 21 is provided on the side surface of the image holding member of the intermediate transfer belt 20 so as to face the driving roller 22.

In addition, each of the color toners of yellow, magenta, cyan, black, and white which is stored in each of the toner cartridges 8Y, 8M, 8C, 8K, and 8W is correspondingly supplied to each of developing devices (an example of the developing unit) 4Y, 4M, 4C, 4K, and 4W of the each of the units 10Y, 10M, 10C, 10K, and 10W.

The first to fifth units 10Y, 10M, 10C, 10K, and 10W have the same configuration, operation, and action as each other, and thus the first unit 10Y for forming a yellow image disposed on the upstream side the travel direction of the intermediate transfer belt will be representatively described.

The first unit 10Y includes a photoreceptor 1Y serving as an image holding member. In the vicinity of the photoreceptor 1Y, a charging roller (an example of the charging unit) 2Y which charges the surface of the photoreceptor 1Y with a predetermined potential, an exposure device (an example of the electrostatic charge image forming unit) 3Y which exposes the charged surface by using a laser beam 3Y based on color separated image signal so as to form an electrostatic charge image, a developing device (an example of the developing unit) 4Y which supplies the charged toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the residues remaining on the surface of the photoreceptor 1Y after primary transfer are sequentially disposed.

The primary transfer roller 5Y is disposed inside the intermediate transfer belt 20, and is provided at a position facing the photoreceptor 1Y. A bias power supply (not shown) which is applied to the primary transfer bias is connected to each of the primary transfer rollers 5Y, 5M, 5C, 5K, and 5W. The bias power supply is changed to the transfer bias which is applied to applying to the primary transfer roller by control of a control unit (not shown).

Hereinafter, an operation of forming a yellow image in the first unit 10Y will be described.

First, before starting the operation, the surface of the photoreceptor 1Y is charged with the potential from −600 V to −800 V by the charging roller 2Y.

The photoreceptor 1Y is formed by stacking the photosensitive layers on the conductive substrate (for example, volume resistivity of equal to or less than $1\times10^{-6}$ Ωcm at 20° C.). The photosensitive layer typically has high resistance (the resistance of the typical resin), but when being irradiated with the laser beam, it has the property of changing the resistivity of a portion which is irradiated with the laser beam. In this regard, in accordance with image data for yellow transmitted from the control unit (not shown), the charged surface of the photoreceptor 1Y is irradiated with the laser beam from the exposure device 3Y. With this, the electrostatic charge image of a yellow image pattern is formed on the surface of the photoreceptor 1Y.

The electrostatic charge image means an image formed on the charged surface of the photoreceptor 1Y, in which resistivity of a portion of the photosensitive layer to be irradiated with the laser beam from the exposure device 3Y is decreased, and the charges for charging the surface of the photoreceptor 1Y flow; on the other hand, electrostatic charge image means a so-called negative latent image which is formed when charges of a portion which is not irradiated with the laser beam remain.

The electrostatic charge image formed on the photoreceptor 1Y is rotated to the predetermined developing position in accordance with the traveling of the photoreceptor 1Y. Further, the electrostatic charge image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image portion on the surface of the photoreceptor 1Y, so that the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roller 5Y and an electrostatic force toward the primary transfer roller 5Y from the photoreceptor 1Y acts on the toner image, so that the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by a photoreceptor cleaning device 6Y.

The primary transfer biases that are applied to the primary transfer rollers 5M, 5C, 5K, and 5W of the second unit 10M and the subsequent units are also controlled in the same manner as in the case of the first unit.

In this manner, the intermediate transfer belt 20 onto which the yellow toner image is transferred in the first unit 10Y is sequentially transported through the second to fifth units 10M, 10C, 10K, and 10W; and the toner images of respective colors are multiply-transferred in a superimposed manner.

The intermediate transfer belt 20 onto which the five color toner images have been multiply-transferred through the first to fifth units reaches a secondary transfer portion that is composed of the intermediate transfer belt 20, the facing roller 24 contacting the inner surface of the intermediate transfer belt, and a secondary transfer roller (an example of the secondary transfer unit) 26 disposed on the image holding surface side of the intermediate transfer belt 20. Meanwhile, a recording sheet (an example of the recording medium) P is supplied to a gap between the secondary transfer roller 26 and the intermediate transfer belt 20, contact each other, via a supply mechanism at a predetermined timing, and a secondary transfer bias is applied to the facing roller 24. The transfer bias applied at this time has the same polarity (−) as the toner polarity (−), and an electrostatic force toward the recording sheet P from the intermediate transfer belt 20 acts on the toner image, so that the toner image on the intermediate transfer belt 20 is transferred onto the recording sheet P. In this case, the secondary transfer bias is determined depending on the resistance detected by a resistance detecting unit (not shown) that detects the resistance of the secondary transfer part, and is voltage-controlled.

Thereafter, the recording sheet P is fed to a nip portion of a pair of fixing roller in a fixing device (an example of the fixing unit) 28 so that the toner image is fixed to the recording sheet P, and thereby a fixed image is formed.

Examples of the recording sheet P, to which the toner image is transferred, include plain paper that is used in electrophotographic copying machine, printers, and the like. As a recording medium, an OHP sheet is also exemplified other than the recording sheet P.

In order to further improve the smoothness of the image surface after fixing, the surface of the recording sheet P may be smooth. For example, coated paper obtained by coating the surface of plain paper with resin or the like, art paper for printing, or the like may be used.

The recording sheet P on which the fixing of the color image is completed is discharged toward a discharge part, and a series of the color image forming operations end.

Process Cartridge and Toner Cartridge Set

A process cartridge according to the exemplary embodiment will be described.

The process cartridge according to the exemplary embodiment is provided with a first developing unit that accommodates a white electrostatic charge image developer in the electrostatic charge image developer set according to the exemplary embodiment, and a second developing unit that accommodates a colored electrostatic charge image developer in the electrostatic charge image developer set according to the exemplary embodiment, and is detachable from an image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
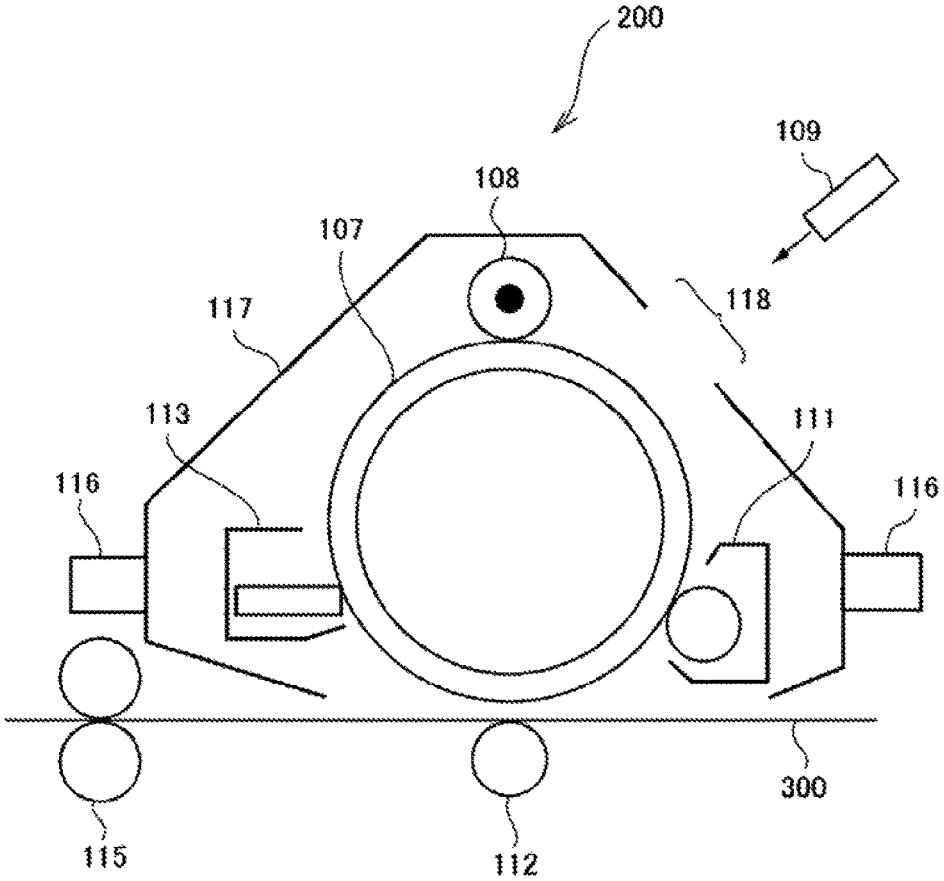
FIG. 2 is a configuration diagram illustrating an example of a process cartridge according to the exemplary embodiment.

FIG. 2 is a configuration diagram illustrating the process cartridge according to this exemplary embodiment.

The process cartridge 200 illustrated in FIG. 2 is configured such that a photoreceptor 107 (an example of the image holding member), a charging roller 108 (an example of the charging unit) which is provided in the vicinity of the photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 2, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge set according to the exemplary embodiment will be described. The toner cartridge set according to the exemplary embodiment is provided with a white toner cartridge that accommodates a white toner included in the toner set according to the exemplary embodiment, and is detectable to the image forming apparatus, and a colored toner cartridge that accommodates a colored toner included in the toner set according to the exemplary embodiment, and is detectable to the image forming apparatus. The toner cartridge set is to accommodate a toner for replenishment for being supplied to the developing unit provided in the image forming apparatus.

The image forming apparatus shown in FIG. 2 has such a configuration that the toner cartridges 8Y, 8M, 8C, 8K, and 8W are detachable therefrom, and the developing devices 4Y, 4M, 4C, 4K and 4W are connected to the toner cartridges corresponding to the respective developing devices (colors) via toner supply tubes (not shown), respectively. In addition, in a case where the content of the toner accommodated in the toner cartridge is decreased, the toner cartridge is replaced.

EXAMPLES

Hereinafter, the exemplary embodiment will be described in detail using Examples and Comparative examples. However, the exemplary embodiment is not limited to the following examples. In the following description, unless specifically noted, "parts" and "%" are based on the weight.

Preparation of Resin Particle Dispersion

Preparation of Resin Particle Dispersion (1)

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above-described materials are put into a 5-L flask equipped with a stirrer, a nitrogen inlet pipe, a temperature sensor, and a rectification column, the temperature of the flask is raised up to 210° C. over one hour, and then 1 part of titanium tetraethoxide is added thereto with respect to 100 parts of the above materials. While distilling off water to be generated, the temperature is raised up to 230° C. over 0.5 hours, dehydration condensation reaction is continued for one hour at the temperature, and then a reaction product is cooled. In this way, a polyester resin (1) having a weight average molecular weight of 18,500, an acid value of 14 mgKOH/g, and a glass transition temperature of 59° C. is synthesized.

40 parts of ethyl acetate and 25 parts of 2-butanol are put into a container provided with a temperature control unit and a nitrogen replacement unit so as to prepare a mixed solvent, then 100 parts of polyester resin (1) is slowly put into the container and dissolved, and 10% by weight of ammonia aqueous solution (equivalent to three times the molar amount with respect to the acid value of the resin) is put into the container and stirred for 30 minutes.

Subsequently, the interior of the container is replaced with dry nitrogen, and 400 parts of ion exchange water is added dropwise at a rate of 2 parts per minute while maintaining the temperature at 40° C. and stirring the mixed solution so as to perform emulsification. After completing the dropwise addition, the temperature of the emulsion is returned to room temperature (from 20° C. to 25° C.) and bubbling with dry nitrogen is performed for 48 hours with stirring, and thus ethyl acetate and 2-butanol are reduced to 1,000 ppm or less, thereby obtaining a resin particle dispersion in which a resin particle having a volume average particle diameter 200 nm is dispersed. The ion exchange water is added to the resin particle dispersion so as to adjust the solid content to 20% by weight, thereby obtaining a resin particle dispersion (1).

Preparation of Coloring Agent Particle Dispersion

Preparation of Yellow Coloring Agent Dispersion (Y1)

Yellow Pigment C.I. PY74 (HansaYellow5GX01 prepared by Clariant Japan K.K.): 70 parts Anionic surfactant (NEOGEN RK prepared by Daiichi Kogyo Seiyaku Co., Ltd.): 1 part Ion exchange water: 200 parts The above-described materials are mixed with each other, and the mixture is dispersed for 10 minutes with a homogenizer (ULTRA-TURRAX T50, manufactured by IKA Ltd). The ion exchange water is added to the mixture such that the solid content in the dispersion is 20% by weight, thereby obtaining a coloring agent dispersion (Y1) in which coloring agent particles having a volume average particle diameter of 190 nm are dispersed. Preparation of white pigment particle dispersion (W1)

White pigment (titanium oxide, product name: CR-60-2 prepared by ISHIHARA SANGYO KAISHA, Ltd.): 210 parts Anionic surfactant (NEOGEN RK prepared by Daiichi Kogyo Seiyaku Co., Ltd.): 10 parts Ion exchange water: 480 parts The above-described materials are mixed with each other, and the mixture is stirred for 30 minutes by using a homogenizer (ULTRA-TURRAX T50, manufactured by IKA Ltd), and then is dispersed for one hour using a high pressure impact type dispersing machine, ULTIMIZER (HJP30006 manufactured by SUGINO MACHINE LIMITED Co., Ltd.), and thereby a white pigment particle dispersion (W1) (solid content of 30%) in which titanium oxide pigments having an average primary particle diameter of 280 nm are dispersed is obtained.

Preparation of Release Agent Particle Dispersion

Preparation of Release Agent Particle Dispersion (1)

Paraffin wax (HNP-9, prepared by Nippon Seiro, Co., Ltd.):100 parts

Anionic surfactant (NEOGEN RK, prepared by Dai-ichi Kogyo Seiyaku Co., Ltd.): 1 part Ion exchange water: 350 parts The above-described materials are mixed with each other, the mixture is heated at 100° C., is dispersed by using a homogenizer (ULTRA-TURRAX T50, manufactured by IKA Ltd.), and then is subjected to a dispersing treatment by using Manton-Gaulin high pressure homogenizer (manufactured by Manton Gaulin Mfg Company Inc), thereby obtaining a release agent particle dispersion (1) (solid content 20% by weight) in which a release agent particle having a volume average particle diameter of 200 nm is dispersed.

Preparation of Yellow Toner Particles

Preparation of Yellow Toner Particles (Y1)

Resin particle dispersion (1): 770 parts

Yellow coloring agent particle dispersion (Y1): 70 parts

Release agent particle dispersion (1): 120 parts

Ion exchange water: 600 parts

The above-described materials are put into a round stainless steel flask, 0.1 N of sulfuric acid is added to the flask to adjust the pH to 3.5, and then 13 parts of aqueous solution having a concentration of aluminum sulfate of 10% are added to the flask. Subsequently, the mixture is dispersed at 30° C. using a homogenizer (ULTRA-TURRAX T50, manufactured by IKA Ltd.), then is heated over 45 minutes at a constant heating rate up to 45° C. in a heating oil bath, and then kept for 30 minutes. Thereafter, 370 parts of resin particle dispersion (1) is added and kept for one hour, the pH is adjusted to 8.5 by adding 0.1 N sodium hydroxide aqueous solution, then the mixture is heated up to 85° C. while being continuously stirred, and kept for five hours. After that, the temperature of the resultant is cooled down to 20° C. at a rate of 20° C./min, filtered, sufficiently washed with ion exchange water, and dried. As a result, yellow toner particles (Y1) are obtained.

Preparation of Yellow Toner Particles (Y2)

Yellow toner particles (Y2) are obtained in the same manner as in the preparation of the yellow toner particles (Y1) except that a heating time within a temperature range from 30° C. to 45° C. after dispersion is changed from 45 minutes to 120 minutes, and an additional amount of the resin particle dispersion (1) is changed from 370 parts to 600 parts.

Preparation of Yellow Toner Particles (Y3)

Yellow toner particles (Y3) are obtained in the same manner as in the preparation of the yellow toner particles (Y1) except that the heating time within a temperature range from 30° C. to 45° C. after dispersion is changed from 45 minutes to 30 minutes.

Preparation of Yellow Toner Particles (Y4)

Yellow toner particles (Y4) are obtained in the same manner as in the preparation of the yellow toner particles (Y1) except that the heating time within a temperature range from 30° C. to 45° C. after dispersion is changed from 45 minutes to 90 minutes.

Preparation of Yellow Toner Particles (Y5)

Yellow toner particles (Y5) are obtained in the same manner as in the preparation of the yellow toner particles Y1) except that the heating time within a temperature range from 30° C. to 45° C. after dispersion is changed from 45 minutes to 30 minutes, and an additional amount of the resin particle dispersion (1) is changed from 370 parts to 600 parts.

Preparation of White Toner Particles

Preparation of White Toner Particles (W1)

Resin particle dispersion (1): 800 parts

White pigment particle dispersion (W1): 270 parts

Release agent particle dispersion (1): 100 parts

Ion exchange water: 700 parts

The above-described materials are put into a round stainless steel flask, 0.1 N of sulfuric acid is added to the flask to adjust the pH to 3.5, and then 13 parts of aqueous solution having a concentration of aluminum sulfate of 10% are added to the flask. Subsequently, the mixture is dispersed at 30° C. using a homogenizer (ULTRA-TURRAX T50, manufactured by IKA Ltd.), then is heated over 120 minutes at a constant heating rate up to 45° C. in a heating oil bath, and then kept for 30 minutes. Thereafter, 45 parts of resin particle dispersion (1) is added and kept for five hours, the pH is adjusted to 8.5 by adding 0.1 N sodium hydroxide aqueous solution, and then the mixture is heated up to 85° C. while being continuously stirred, and kept for five hours. After that, the temperature of the resultant is cooled down to 20° C. at a rate of 20° C./min, filtered, sufficiently washed with ion exchange water, and dried. As a result, white toner particles (W1) are obtained.

Preparation of White Toner Particles (W2)

White toner particles (W2) are obtained in the same manner as in the preparation of the yellow toner particles (W1) described above except that a heating time within a temperature range from 30° C. to 45° C. after dispersion is changed from 120 minutes to 110 minutes, and an additional amount of the resin particle dispersion (1) is changed from 45 parts to 120 parts.

Preparation of White Toner Particles (W3)

White toner particles (W3) are obtained in the same manner as in the preparation of the yellow toner particles (W1) except that a heating time within a temperature range from 30° C. to 45° C. after dispersion is changed from 120 minutes to 100 minutes, and an additional amount of the resin particle dispersion (1) is changed from 45 parts to 180 parts.

Preparation of White Toner Particles (W4)

White toner particles (W4) are obtained in the same manner as in the preparation of the yellow toner particles (W1) except that a heating time within a temperature range from 30° C. to 45° C. after dispersion is changed from 120 minutes to 80 minutes, and an additional amount of the resin particle dispersion (1) is changed from 45 parts to 300 parts.

Preparation of White Toner Particles (W5)

White toner particles (W5) are obtained in the same manner as in the preparation of the yellow toner particles (W1) except that a heating time within a temperature range from 30° C. to 45° C. after dispersion is changed from 120 minutes to 75 minutes, and an additional amount of the resin particle dispersion (1) is changed from 45 parts to 300 parts.

Preparation of White Toner Particles (W6)

White toner particles (W6) are obtained in the same manner as in the preparation of the yellow toner particles (W1) except that a heating time within a temperature range from 30° C. to 45° C. after dispersion is changed from 120 minutes to 130 minutes, and an additional amount of the resin particle dispersion (1) is changed from 45 parts to 0 part.

Preparation of Toners 100 parts of each of yellow toner particles (Y1) to (Y5) or white toner particles (W1) to (W6), and 1.0 parts of silica particles (RY50 prepared by Nippon Aerosil Co., Ltd.) are mixed for three minutes at a peripheral speed of 30 m/sec by using a HENSCHEL MIXER (manufactured by Mitsui Miike Machinery Co., Ltd.). After that, the resultant is sieved by using a screen with an aperture of 45 μm, and thereby yellow toners (YT1 to YT5) and white toners (WT1 to WT6) are prepared.

Preparation of Developers

Ferrite particle (number average particle diameter of 50 μm): 100 parts

Toluene: 14 parts

Copolymer of styrene and methyl methacrylate (copolymerization ratio of 15/85): 3 parts Carbon black: 0.2 parts The above-described components except for the ferrite particle are dispersed by using a sand mill so as to prepare a dispersion, and the obtained dispersion is put into a vacuum degassing type kneader, together with the ferrite particle, and is stirred and dried under reduced pressure, thereby obtaining a carrier.

Then, 8 parts of yellow toners (YT1) to (YT5) or white toners (WT1) to (WT6) are mixed to 100 parts of the carrier, and thereby yellow developers (YD1 to YD5) and white developers (WD1 to WD6) are obtained.

Various Measurements

Regarding the obtained white toner particles and yellow toner particles, the average equivalent circle diameters [Rw1] and [Rc1] of the cores, the average equivalent circle diameters [Rw2] and [Rc2] of the toner particles, and average thicknesses [Tw1] and [Tc1] of the coating layers are measured according to the above-described methods.

Examples 1 to 8, and Comparative Examples 1 to 4

The white toner (white developer) and the yellow toner (yellow developer) described in the following Table 1 are combined so as to obtain a toner set.

Evaluation

Evaluation of Concealing Properties and Color Development

By using the toner set in the respective Examples and Comparative Examples, an image is formed through the following method.

A modified machine, DOCUCENTRE COLOR F450 manufactured by Fuji Xerox Co., Ltd. is prepared, and the toner set described in Table 1 is put into a developing device. By using this image forming apparatus, (1) a white solid image having a toner weight of 12.0 g/m$^2$, and (2) an image in which a white image having a toner weight of 12.0 g/m$^2$ is set as a lower layer and a yellow solid image having a toner weight of 6.0 g/m$^2$ is superimposed thereon are formed on Fuji Xerox PPC/laser OHP film.

Regarding the obtained image, the concealing properties of the base (white image), and the color development (ΔE) of the yellow image are evaluated as follows.

Regarding the concealing properties of the base (white image) (concealing rate): a white portion and a black portion of the concealment ratio test paper described in JIS K 5600-4 are underlaid below the white image solid image portion on the obtained OHP film, and then a tristimulus value Y of the white solid image is measured by using the X-RITE 938 (product name) manufactured by X-Rite Inc. When the white portion is underlaid, the Y value is designated as Yw, and when the black portion is underlaid, the Y value is designated as Yb. Then, Yb/Yw is calculated so as to determine the concealing properties (concealing rate).

The concealing properties are determined that a case of equal to or greater than 80% is rated as "A", a case of equal to or greater than 70% and less than 80% is rated as "B", and a case of less than 70% is rated as "C".

Color development (ΔE) of the yellow image: regarding an image in which the white image is set as a lower layer and the yellow solid image is superimposed thereon as an upper layer, L*a*b* (designated as L*(1), a*(1), and b*(1)) is measured when the black portion of the concealment ratio test paper is underlaid. Regarding this, a color difference ΔE from a target color value (designated as L*(2), a*(2), and b*(2)) is calculated from the following expression, and the obtained value is designated as an indicator of color development.

$$\Delta E=[(L^*(1)-L^*(2))^2+(a^*(1)-a^*(2))^2+(b^*(1)-b^*(2))^2]^{1/2} \quad \text{(Expression)}$$

Regarding the color development, a case of equal to or less than 5 is rated as "A", a case of greater than 5 and equal to or less than 10 is rated as "B", and a case of greater than 10 is rated as "C".

TABLE 1

| | | White toner | | | | | | Yellow toner | | | | | |
|---|---|---|---|---|---|---|---|---|---|---|---|---|---|
| | | Types | Equivalent circle diameter of core Rw1 | Equivalent circle diameter of toner particles Rw2 | [Rw2 − Rw1] | [Rw1/Rw2] | Thickness of coating layer Tw1 | Types | Equivalent circle diameter of core Rc1 | Equivalent circle diameter of toner particles Rc2 | [Rc2 − Rc1] | [Rc1/Rc2] | Thickness of coating layer Tc1 |
| Example | 1 | WT1 | 7.40 | 7.50 | 0.10 | 0.987 | 0.1 | YT1 | 5.10 | 5.90 | 0.80 | 0.864 | 0.8 |
| | 2 | WT2 | 7.20 | 7.50 | 0.30 | 0.960 | 0.3 | YT1 | 5.10 | 5.90 | 0.80 | 0.864 | 0.8 |
| | 3 | WT3 | 7.00 | 7.50 | 0.50 | 0.933 | 0.5 | YT1 | 5.10 | 5.90 | 0.80 | 0.864 | 0.8 |
| | 4 | WT2 | 7.20 | 7.50 | 0.30 | 0.960 | 0.3 | YT3 | 3.70 | 4.70 | 1.00 | 0.787 | 1.0 |
| | 5 | WT4 | 6.00 | 6.70 | 0.70 | 0.896 | 0.7 | YT2 | 7.50 | 8.30 | 0.80 | 0.904 | 0.8 |
| | 6 | WT4 | 6.00 | 6.70 | 0.70 | 0.896 | 0.7 | YT3 | 3.70 | 4.70 | 1.00 | 0.787 | 1.0 |
| | 7 | WT1 | 7.40 | 7.50 | 0.10 | 0.987 | 0.1 | YT4 | 6.40 | 6.70 | 0.30 | 0.955 | 0.3 |
| | 8 | WT1 | 7.40 | 7.50 | 0.10 | 0.987 | 0.1 | YT5 | 3.70 | 5.30 | 1.60 | 0.698 | 1.6 |
| Comparative Example | 1 | WT5 | 5.90 | 6.70 | 0.80 | 0.881 | 0.8 | YT1 | 5.10 | 5.90 | 0.80 | 0.864 | 0.8 |
| | 2 | WT4 | 6.00 | 6.70 | 0.70 | 0.896 | 0.7 | YT4 | 6.40 | 6.70 | 0.30 | 0.955 | 0.3 |
| | 3 | WT6 | 7.50 | 7.50 | 0.00 | 1.000 | 0 | YT1 | 5.10 | 5.90 | 0.80 | 0.864 | 0.8 |
| | 4 | WT3 | 7.00 | 7.50 | 0.50 | 0.933 | 0.5 | YT4 | 6.40 | 6.70 | 0.30 | 0.955 | 0.3 |

TABLE 2

| | | Evaluation | |
|---|---|---|---|
| | | Concealing properties | Color development |
| Example | 1 | A | A |
| | 2 | A | A |
| | 3 | B | A |
| | 4 | A | B |
| | 5 | B | B |
| | 6 | B | B |
| | 7 | B | A |
| | 8 | B | B |
| Comparative Example | 1 | C | B |
| | 2 | B | C |
| | 3 | C | C |
| | 4 | C | C |

From the above results, it is understood that in this Examples, high concealing properties in the white toner image and high color development in the colored toner image are compatible with each other as compared with Comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner set comprising:

a white toner that includes white toner particles containing a core ($W_{in}$) containing a binder resin and a white coloring agent, and a coating layer ($W_{out}$) which covers the core ($W_{in}$) and contains a binder resin without containing a coloring agent; and a colored toner that includes colored toner particles containing a core ($C_{in}$) containing a binder resin and a colored coloring agent, and a coating layer ($C_{out}$) which covers the core ($C_{in}$) and contains a binder resin without containing a coloring agent;

wherein with respect to a difference between an average equivalent circle diameter [Rw1] of the cores ($W_{in}$) in the white toner particles and an average equivalent circle diameter [Rw2] of the white toner particles [Rw2−Rw1], and a difference between the average equivalent circle diameter [Rc1] of the cores ($C_{in}$) in the colored toner particles and the average equivalent circle diameter [Rc2] of the colored toner particles [Rc2−Rc1], a relationship of the following Expression (1) is satisfied:

$$[Rw2-Rw1]<[Rc2-Rc1] \quad (1),$$

wherein 5.0 μm≤Rw2≤10.0 μm and 3.0 μm≤Rc2≤7.0 μm, and wherein a ratio [Rw1/Rw2] satisfies a relationship 0.896≤Rw1/Rw2<0.987, a ratio [Rc1/Rc2] satisfies a relationship 0.698≤Rc1/Rc2<0.955, and the ratio [Rw1/Rw2] is greater than the ratio [Rc1/Rc2].

2. The electrostatic charge image developing toner set according to claim 1, wherein an average thickness [Tw1] of coating layers ($W_{out}$) of the white toner particles satisfies a relationship expressed by 0.1 μm≤Tw1≤0.5 μm, and an average thickness [Tc1] of coating layers ($C_{out}$) of the colored toner particles satisfies a relationship expressed by 0.5 μm≤Tc1≤1.5 μm.

3. The electrostatic charge image developing toner set according to claim 1, wherein the average equivalent circle diameter [Rw2] of the white toner particles and the average equivalent circle diameter [Rc2] of the colored toner particles satisfy a relationship of the following Expression (3):

$$[Rw2]>[Rc2] \quad (3).$$

4. The electrostatic charge image developing toner set according to claim 1, wherein a value of [Rw2−Rw1] in the white toner particles satisfies a relationship expressed by 0.1 μm≤Rw2−Rw1≤0.5 μm, and a value of [Rc2−Rc1] in the colored toner particles satisfies a relationship expressed by 0.5 μm≤Rc2−Rc1≤1.5 μm.

5. The electrostatic charge image developing toner set according to claim 1, wherein a ratio of [Rw2] to [Rc2] is from 1:0.5 to 1:0.95.

6. The electrostatic charge image developing toner set according to claim 1, wherein an average circularity of the white toner particles and an average circularity of the colored toner particles each independently is from about 0.94 to about 1.00.

7. An electrostatic charge image developer set comprising:

a white electrostatic charge image developer that contains the white toner included in the electrostatic charge image developing toner set according to claim 1; and a colored electrostatic charge image developer that contains the colored toner included in the electrostatic charge image developing toner set according claim 1.

8. A toner cartridge set comprising:

a white toner cartridge that accommodates the white toner included in the electrostatic charge image developing toner set according to claim 1 and is detachable from an image forming apparatus; and a colored toner cartridge that accommodates the colored toner included in the electrostatic charge image developing toner set according to claim 1 and is detachable from the image forming apparatus.

* * * * *